US005627518A

United States Patent [19]

Wishart

[11] Patent Number: 5,627,518

[45] Date of Patent: May 6, 1997

[54] INFRARED ANIMAL DETECTOR AND DRIVER WARNING SYSTEM

[76] Inventor: James F. Wishart, P.O. Box 323, Heppner, Oreg. 97836

[21] Appl. No.: 636,223

[22] Filed: Apr. 23, 1996

[51] Int. Cl.[6] ..... G08B 13/18

[52] U.S. Cl. ..... 340/567; 340/573

[58] Field of Search ..... 340/567, 435, 340/903, 573, 565, 384.2

[56] References Cited

U.S. PATENT DOCUMENTS 4,275,385 6/1981 White ..... 340/312
5,214,408 5/1993 Asayama ..... 340/435
5,214,411 5/1993 Herbruck ..... 340/573
5,461,231 10/1995 Sugiman et al. ..... 250/342

*Primary Examiner*—Jeffery Hofsass
*Assistant Examiner*—Sihong Huang
*Attorney, Agent, or Firm*—John Gugliotta; David Volk

[57] ABSTRACT

An animal detector and driver warning system is provided having a compact and portable housing supported to the dashboard of a car or truck by a mounting bracket. A thermometer is included for reading and indicating ambient temperature, and an infrared sensor is mounted in the housing for reading and indicating localized increased fluctuations in infrared radiation. A signal processor converts the sensed radiation signal from the infrared sensor, and it is displayed on a temperature intensity indicator. Ambient temperature is also displayed and monitored.

4 Claims, 2 Drawing Sheets

INFRARED ANIMAL DETECTOR AND DRIVER WARNING SYSTEM

RELATED APPLICATIONS AND DISCLOSURE DOCUMENTS

This application is a continuation of the invention described in the Disclosure Document No. 385,764, dated Dec. 4, 1995.

BACKGROUND OF THE INVENTION

1. Field of the Invention

The present invention relates generally to infrared detectors and, more particularly, to an infrared animal detector and driver warning system for alerting a driver of the presence of a path-crossing animal.

2. Description of the Related Art

Many car and truck owners at one time or another have encountered near misses with deer and other wild animals. Should a vehicle make contact with a deer, extreme damage to the automobile is likely, while in some instances, injury and even death to the driver or occupants have occurred. According to the records of the U.S. Department of Transportation, in 1993, there were 95 recorded human fatalities caused by collisions with animals, 13,000 reported injuries, and over 225,000 reported instances of property damage resulting from vehicular collisions with animals.

In the related art, many methods of detecting the nearby presence of animals are known. For example, in U.S. Pat. No. 5,461,231, issued in the name of Sugimoto et al., a passive type moving object detection system is disclosed including a stationary infrared detector for detecting passage across a detection zone. Also, in U.S. Pat. No. 5,214,408, issued in the name of Asayama, a distance detecting apparatus for a vehicle is disclosed for determining the distance to a plurality of objects present in a driver's field of view.

However, none of these devices as disclosed are capable of being adapted for portable use in an automobile for warning drivers of potential collisions with wildlife such as deer, elk, and the like. One attempt to repel such animals is known in U.S. Pat. No. 5,214,411, issued in the name of Herbruck, wherein an ultrasonic animal repelling apparatus is disclosed. Once again, such an apparatus is unadaptable for use with an automobile, would be affected by temperature and vehicle speed, and would sustain limited success in repelling only a limited number of different animal types.

Consequently, a need has been felt for providing an apparatus and method which detects an animal crossing a vehicle's path and alerts a driver of the presence of such animals.

SUMMARY OF THE INVENTION

It is therefore an object of the present invention to provide an improved animal detection and driver alert apparatus.

It is a feature of the present invention to provide an improved animal detection and driver alert apparatus which utilizes passive infrared sensors to detect the "body heat" of an animal which may be crossing the path of an oncoming vehicle.

Briefly described according to the preferred embodiment of the present invention, an apparatus is disclosed having a mounting bracket which sets on the dashboard of the car or truck and is similar in appearance to automotive radar detectors. A control panel is on the front of the unit which is visible to the driver. From left to right on this control panel is the on/off switch, the LED on/off light, the temperature LED readout and audio speaker. Above these components on the panel are LED lights which indicate temperature intensity. On the side opposite the control panel is an infrared detection beam thermometer which registers the exterior temperature and distinguishes such fluctuations. This entire unit attaches to the dashboard through use of a mounting bracket; from the base of this unit, two small cables extend and connect to a 12-volt DC power supply.

An advantage of the present invention is that the driver is alerted of potential dangers ahead, and is therefore given time to make preventative maneuvers.

Further, the preferred embodiment of the present invention is easily adaptable for use with automobiles, and remains effective during daylight or nighttime driving.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

1. Detailed Description of the Figures

Figure 1:
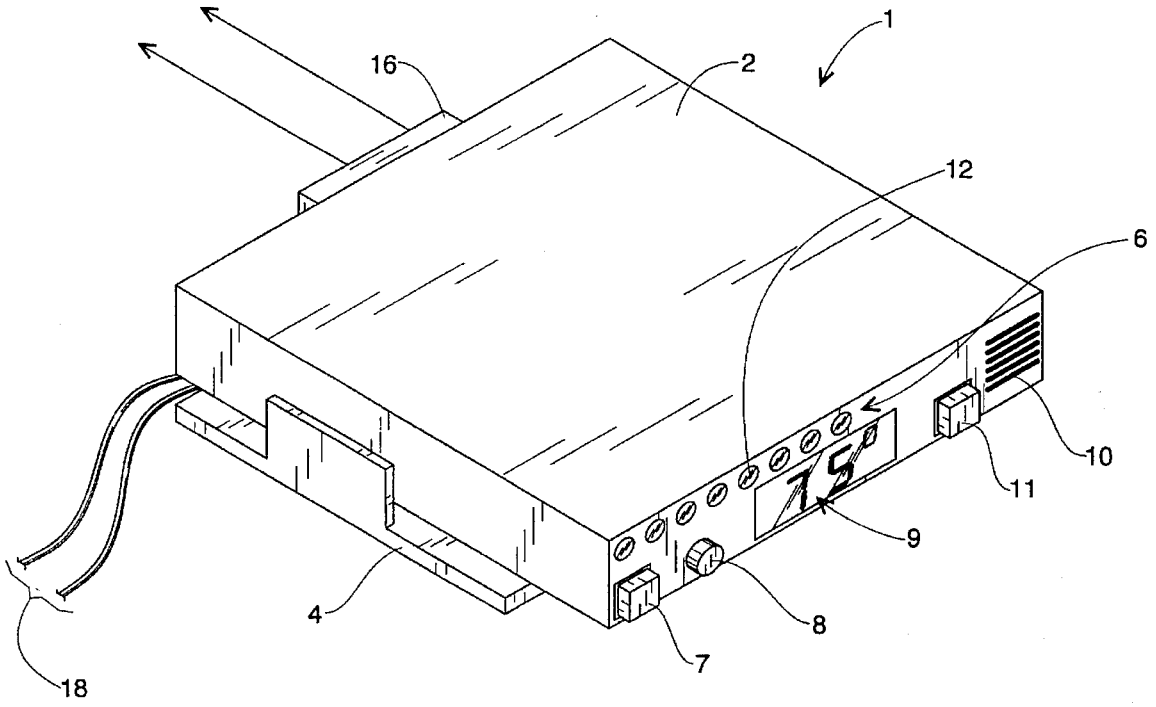
FIG. 1 is a perspective view of an infrared animal detector and driver warning system according to the preferred embodiment of the present invention.

Referring now to FIG. 1, an infrared animal detector and driver warning system 1 is shown, according to the present invention, having a detector housing 2 supported by a mounting bracket 4 which sets on the dashboard of the car or truck (not shown ) and is similar in appearance to an automotive radar detector. A control panel 6 is on the front of the housing 2 is visible to the driver. From left to right on this control panel is an on/off switch 7, an LED on/off indicator 8, an LED temperature readout 9 and audio speaker 10 with an audio on/off switch 11. Across the top of the control panel 6 is a temperature intensity indicator 12. On the side opposite the control panel is an infrared detection beam thermometer 16 which registers the exterior temperature and distinguishes such fluctuations. Two small electrical cables 18 extend to connect to a 12-volt DC power supply (not shown).

Figure 2:
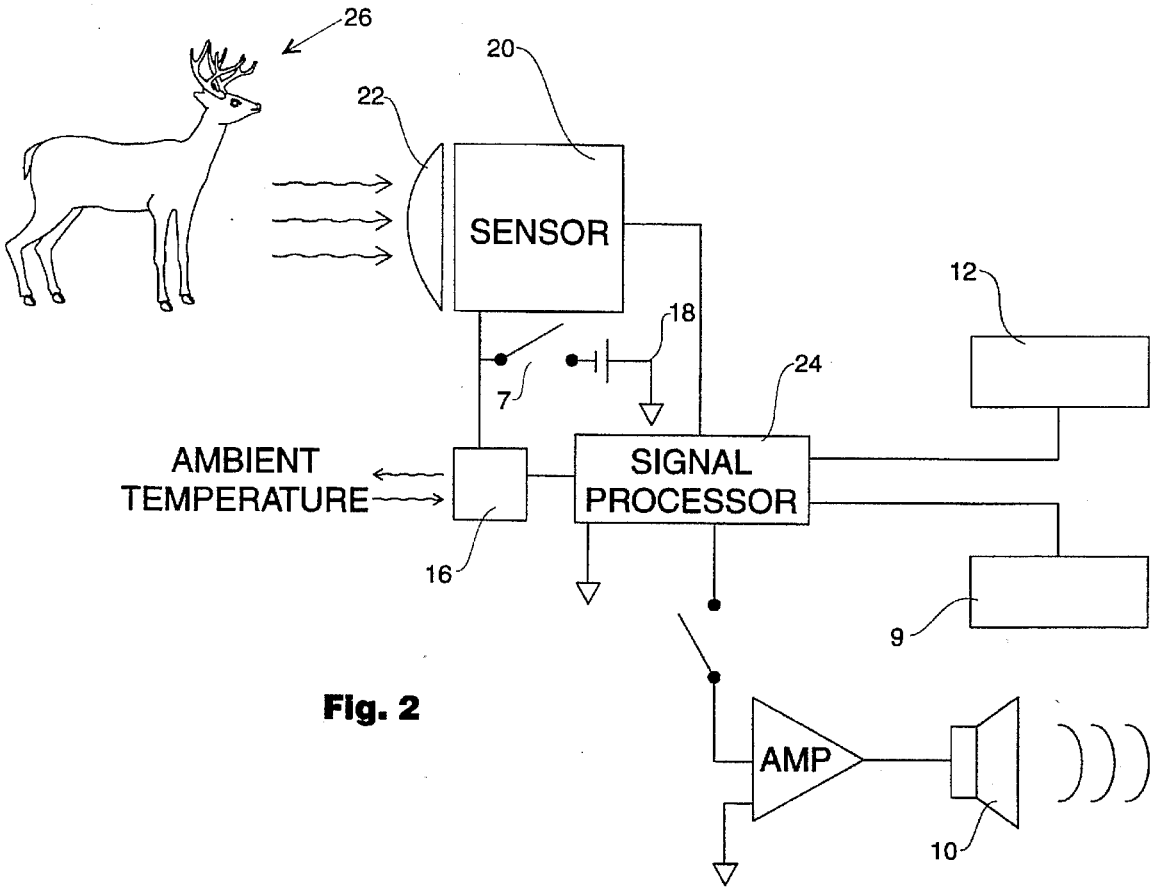
FIG. 2 is an electrical schematic of the circuitry for the device of FIG. 1.

Referring to FIG. 2, the operation of the detector 1 is more clearly shown. The infrared detection beam thermometer 16 is in communication with a signal processor 24. An infrared sensor 20 is also in communication with the signal processor 24. The signal processor 24 converts the sensed signal from the infrared sensor 20 into an electronic signal to drive the temperature intensity indicator 12 in proportion to the sensed intensity of the infrared radiation given off by an animal 26. It is envisioned that an infrared lens 22 may be required to focus and intensify the infrared image onto the infrared sensors 20. Further, the signal processor 24 also communicates with and activates the speaker 10 to initiate an audible alarm to alert the driver to inspect the temperature intensity indicator 12 in order to verify the presence of a path crossing animal. Similarly, the signal processor 24 also converts the sensed signal from the thermometer 16 into an electronic signal to drive the temperature readout 9, envisioned as an LED indicator. It is envisioned that for the signal processor 24 to communicate with the speaker 10, an audible temperature signal may be required to be transmitted to an amplifier prior to communicating with the speaker 10 such that the user can adjust the intensity of the transmitted audible signal.

2. Operation of the Preferred Embodiment

To use the present invention, the detector housing 2 is mounted to the center of the dash board of a vehicle with the mounting bracket 4. The housing can then be aligned such that the infrared detection beam 16 and infrared sensors (not shown) are facing toward the front of the vehicle. The cables 18 can then be connected to the power supply of the vehicle, either in a direct wire fashion, or with an adapter plug such as the type generally available for connecting with an automobile cigarette lighter. Upon activation, the exterior temperature will register on the temperature readout 9 through use of the infrared detection beam thermometer 16. Gradual changes in temperature will not cause the alarm to sound or illuminate. If, however, the infrared sensors 20 detect a strong temperature fluctuation, suggesting the presence of an animal, it will cause the temperature intensity indicator 12 to come on and the audio speaker 10 to alarm. After the initial alarm sounds, this audible warning will decrease in decibels by 50 percent and the temperature intensity indicator will continue to illuminate until the animal is avoided and passed. The detector 1 will automatically reset itself after such a warning.

The foregoing description is included to illustrate the operation of the preferred embodiment and is not meant to limit the scope of the invention. It is envisioned that one skilled in the art could contribute additional changes and modifications gather from the present teachings of the preferred embodiment. Therefore, the scope of the invention is to be limited only by the following claims.

What is claimed is:

1. An animal detector and driver warning system comprising:

a detector housing, said housing being compact and portable and having a front control panel on a front of said housing;

a mounting bracket for affixing to and supporting said detector housing, said mounting bracket for temporarily attaching to the dashboard of the car or truck;

a thermometer mounted in said housing for reading and indicating ambient temperature;

an infrared sensor mounted in said housing for reading and indicating localized increased fluctuations in infrared radiation;

a signal processor for converting the sensed radiation signal from said infrared sensor into a first electronic signal, said signal processor further for receiving and converting the ambient temperature signal from said thermometer into a second electronic signal; and a temperature intensity indicator for receiving said first electronic signal and displaying temperature intensity in proportion to the sensed intensity of the infrared radiation given off by the animal and received by said infrared sensor.

2. The animal detector and driver warning system as described in claim 1, further comprising:

an infrared lens in visual communication with said infrared sensor for focusing and intensifying an infrared image onto said infrared sensor.

3. The animal detector and driver warning system as described in claim 1, further comprising:

a speaker in communication with said signal processor, said speaker for providing an audible alarm to alert a driver upon initiation by said signal processor.

4. The animal detector and driver warning system as described in claim 1, further comprising:

a temperature readout in communication with said thermometer for providing a visual indication of the sensed ambient temperature.

* * * * *